US011872668B2

(12) United States Patent
Kuntheeya

(10) Patent No.: US 11,872,668 B2
(45) Date of Patent: Jan. 16, 2024

(54) PORTABLE POWER TOOL

(71) Applicant: MAKITA CORPORATION, Anjo (JP)

(72) Inventor: Chitphong Kuntheeya, Amphur Sriracha (TH)

(73) Assignee: MAKITA CORPORATION, Anjo (JP)

( * ) Notice: Subject to any disclaimer, the term of this patent is extended or adjusted under 35 U.S.C. 154(b) by 259 days.

(21) Appl. No.: 17/374,305

(22) Filed: Jul. 13, 2021

(65) Prior Publication Data

US 2022/0016738 A1 Jan. 20, 2022

(30) Foreign Application Priority Data

Jul. 15, 2020 (JP) ..... 2020-121630

(51) Int. Cl.

| | |
|---|---|
| ***B24B 23/03*** | (2006.01) |
| ***B24B 41/047*** | (2006.01) |
| ***B24B 23/04*** | (2006.01) |
| ***B24B 47/10*** | (2006.01) |

(52) U.S. Cl.

CPC ..... *B24B 23/03* (2013.01); *B24B 23/04* (2013.01); *B24B 41/0475* (2013.01); *B24B 47/10* (2013.01)

(58) Field of Classification Search

None

See application file for complete search history.

(56) References Cited

U.S. PATENT DOCUMENTS

| | | | | |
|---|---|---|---|---|
| 4,625,462 A | | 12/1986 | Fushiya et al. | |
| 5,913,903 A | * | 6/1999 | Matsuda | D04B 23/22 66/193 |
| 6,132,300 A | * | 10/2000 | Martin | B24B 23/03 451/357 |

(Continued)

FOREIGN PATENT DOCUMENTS

| | | | |
|---|---|---|---|
| JP | S6161761 | A | 3/1986 |
| JP | 2009166147 | A | 7/2009 |

(Continued)

OTHER PUBLICATIONS

WO2018168421A1_Translation.pdf (Year: 2018).*
Unpublished U.S. Appl. No. 17/363,487.

*Primary Examiner* — Bryan R Muller
*Assistant Examiner* — Dana Lee Poon
(74) *Attorney, Agent, or Firm* — J-TEK LAW PLLC; Jeffrey D. Tekanic; Scott T. Wakeman

(57) ABSTRACT

A portable power tool includes an electric motor having a motor shaft, an output shaft arranged in parallel to the motor shaft and configured to be driven by rotation of the motor shaft, a tool accessory operably connected to the output shaft and configured to undergo an orbital and/or rotational motion in response to rotation of the output shaft, a first bearing that rotatably supports the output shaft, and a second bearing that rotatably supports the output shaft and is arranged closer to the tool accessory than the first bearing in an axial direction in which the output shaft extends. The first and second bearings are arranged at positions that do not (Continued)

overlap with a radially outermost one of components of the electric motor when viewed in a shaft arrangement direction in which the motor shaft and the output shaft are arranged in parallel.

20 Claims, 7 Drawing Sheets

(56) References Cited

U.S. PATENT DOCUMENTS

| | | | | |
|---|---|---|---|---|
| 7,291,062 | B2 * | 11/2007 | Kiss | B24B 23/04 451/356 |
| 9,061,393 | B2 * | 6/2015 | Sugita | B24B 23/04 |
| 9,114,500 | B2 | 8/2015 | Sugita et al. | |
| 2006/0211351 | A1 * | 9/2006 | Ikeda | B24B 55/10 451/456 |
| 2009/0298403 | A1 * | 12/2009 | Yamashiro | B23Q 11/0042 451/453 |
| 2013/0165026 | A1 * | 6/2013 | Sugita | B24B 23/04 451/357 |
| 2019/0070705 | A1 | 3/2019 | Ishikawa | |

FOREIGN PATENT DOCUMENTS

| | | | |
|---|---|---|---|
| JP | 2013129014 | A | 7/2013 |
| JP | 2013129015 | A | 7/2013 |
| JP | 2013129016 | A | 7/2013 |
| JP | 2014148024 | A | 8/2014 |
| JP | 2019042891 | A | 3/2019 |
| WO | 2018168421 | A1 | 9/2018 |
| WO | WO-2018168421 | A1 * | 9/2018 |

* cited by examiner

B–B

PORTABLE POWER TOOL

CROSS-REFERENCE TO RELATED APPLICATION

The present application claims priority to Japanese patent application no. 2020-121630 filed on Jul. 15, 2020, the contents of which are hereby fully incorporated herein by reference.

TECHNICAL FIELD

The present disclosure relates to portable (e.g., hand-held) power tools having a tool accessory that orbits and/or rotates to perform a processing operation on a workpiece or surface, such as sanding, abrading, polishing or grinding.

BACKGROUND

Some known portable (hand-held) power tools include an electric motor, an output shaft that is arranged in parallel to a motor shaft of the electric motor and is configured to be driven by rotation of the motor shaft, and a tool accessory that is connected to the output shaft and is configured to undergo orbital and/or rotating motion in response to rotation of the output shaft. For example, WO 2018/168421A1 and US 2013/165026 A1 each disclose a sander that has two such shafts. In a sander of this type, rotation of the motor shaft is decelerated and transmitted to the output shaft and thus to the tool accessory. Further, in the sander disclosed in US 2013/165026, that is, a sander in which a battery is used as the power source for the electric motor and is arranged such that it protrudes rearward beyond a housing, the electric motor is arranged on a side opposite to the battery relative to the output shaft so that the center of gravity of the sander does not excessively deviate towards the battery side. Thus, the pressing force of weight of the sander pressing towards a workpiece is distributed uniformly, so that the workpiece can be evenly sanded.

SUMMARY

According to one non-limiting, representative aspect of the present disclosure, a portable (hand-held) power tool may include an electric motor having a motor shaft, an output shaft (spindle) arranged in parallel to the motor shaft and configured such that rotational energy output by the motor shaft is transmitted thereto, a tool accessory operably connected to the output shaft and configured to undergo orbital and/or rotating motion in response to rotation of the output shaft, a first bearing that rotatably supports the output shaft, and a second bearing that rotatably supports the output shaft. The second bearing is arranged closer to the tool accessory than the first bearing in an axial direction in which the output shaft extends. Furthermore, the first and second bearings are arranged at positions that do not overlap with a radially outermost one of components of the electric motor when viewed from (in) a shaft arrangement direction in which the motor shaft and the output shaft are arranged in parallel.

In such a portable power tool, the first and second bearings that support the output shaft do not interfere with the components of the electric motor. Therefore, compared with a structure in which, when viewed from (in) the shaft arrangement direction, at least one of the first and second bearings overlaps with a component (hereinafter also referred to as an outermost component) located on the radially outermost side among the components of the electric motor, the distance between the motor shaft and the output shaft can be reduced. Therefore, the size of the portable power tool can be reduced in the shaft arrangement direction (e.g., in the front-rear direction). For example, in a structure in which the first bearing overlaps with the outermost component of the electric motor when viewed from (in) the shaft arrangement direction, the output shaft, the first bearing, a retainer for holding the first bearing, and the outermost component are arranged side by side in the shaft arrangement direction. On the other hand, according to this embodiment of the present disclosure, the distance between the motor shaft and the output shaft can be reduced by the amount of an installation space for the first bearing and the retainer at the maximum within a range in which the motor shaft is not in contact with the outermost component.

DETAILED DESCRIPTION OF THE EMBODIMENT

Figure 1:
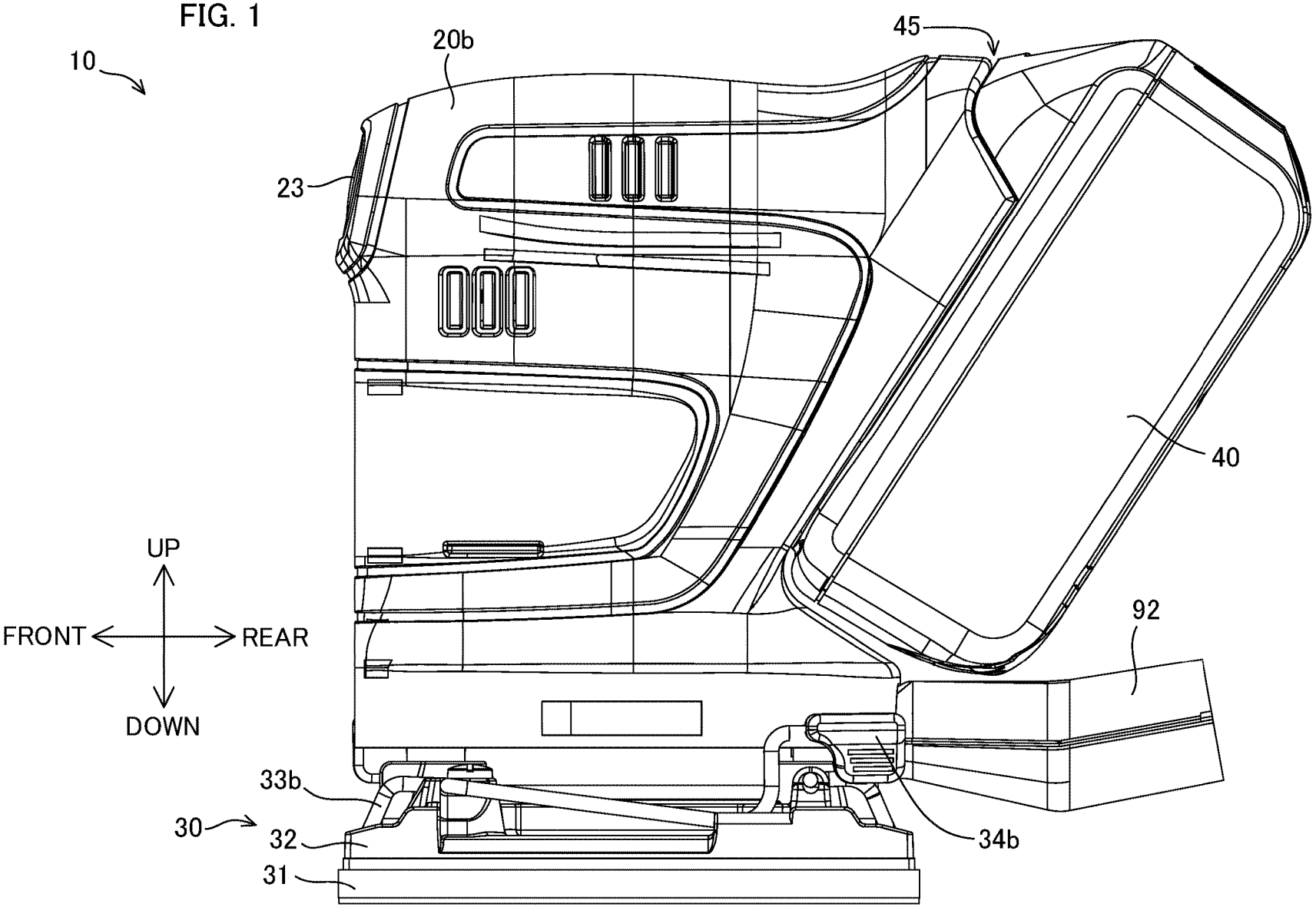
FIG. 1 is a left side view showing a sander according to one representative, non-limiting embodiment of the present disclosure.

According to one non-limiting embodiment of the present disclosure, the first bearing may be arranged to partially overlap with the electric motor when viewed from (in) the axial direction of the output shaft. According to this embodiment, the distance between the motor shaft and the output shaft can be further reduced.

In addition or in the alternative to the preceding embodiment, the portable power tool may include a controller configured to control operation of the electric motor.

In addition, the controller may be arranged on a side opposite of the motor shaft with respect to the output shaft in the shaft arrangement direction. According to this embodiment, the controller is arranged relatively far apart from the electric motor, so that the controller is less affected by heat generation of the electric motor.

In addition or in the alternative, the controller may be arranged at a position that at least partially overlaps with the output shaft in the axial direction of the output shaft. According to this embodiment, the size of the portable power tool can be reduced in the axial direction, compared with a structure in which the controller is arranged farther apart from the tool accessory than the output shaft in the axial direction.

In addition or in the alternative to the preceding embodiments, the portable power tool may include a battery mounting part. The battery mounting part may be arranged on a first lateral side that is opposite to the motor shaft with respect to the output shaft in the shaft arrangement direction and configured such that a battery (battery pack or battery cartridge) serving as a power source of the electric motor is detachably mounted thereon. The battery mounting part may be arranged to hold the battery inclined to extend away from the output shaft in a direction toward a first side on which the first bearing is located and away from a second side on which the second bearing is located. The controller may be arranged between the output shaft and the battery mounting part in the shaft arrangement direction and may be inclined so as to extend away from the output shaft in the direction toward the first side on which the first bearing is located and away from the second side on which the second bearing is located. According to this embodiment, the battery and the controller are arranged in an inclined manner, so that the size of the portable power tool can be reduced in the axial direction, compared with a structure in which the battery and the controller are arranged in parallel in (with) the axial direction of the output shaft.

In addition or in the alternative to the preceding embodiments, the portable power tool may include the battery.

In an embodiment in which the battery mounting part is arranged to be inclined with respect to the axial direction of the output shaft, the portable power tool may include a housing that houses the electric motor, the output shaft, the first bearing, the second bearing and the controller. The housing may be shaped and sized such that a user can hold a part of the housing on a side opposite to the second bearing relative to the first bearing in the axial direction. The battery mounting part may be arranged on an end part of the housing on the side opposite to the motor shaft with respect to the output shaft in the shaft arrangement direction. According to this embodiment, owing to the inclined arrangement of the battery mounting part, the battery mounted on the battery mounting part does not protrude outward in the axial direction beyond a portion of the housing that is configured to be held by the user during a processing operation. Therefore, when the user holds the housing and performs, e.g., a sanding or polishing operation, the battery is prevented from interfering with an arm of the user. Moreover, it is possible to make the housing part, which is configured to be held by the user, larger along the shaft arrangement direction. Therefore, the housing is easy for the user to hold. Furthermore, with the inclined arrangement of the battery as described above, although the center of gravity of the portable power tool tends to deviate to the battery side relative to the output shaft, the user can hold an area closer to the center of gravity since the part to be held by the user is extended toward the battery. Therefore, the user can stably hold the portable power tool with a smaller gripping force.

In addition or in the alternative to the preceding embodiments, the housing may be shaped and sized not to protrude outward beyond the tool accessory in a direction from the output shaft toward the motor shaft. According to this embodiment, the housing is prevented from interfering with sanding/polishing operation. For example, if the housing were to instead (disadvantageously) protrude outward beyond the tool accessory, during a sanding/polishing operation, the housing may come into contact with a protruding part of a workpiece or surrounding objects, such that the tool accessory might not be able to reach every corner of an area to be sanded or polished. According to this embodiment, however, such a problem does not occur. In the portable power tool according to the above-described aspects of the present disclosure, the distance between the motor shaft and the output shaft can be reduced, so that this embodiment is easily realized even when manufacturing a portable power tool of a small size (in which the tool accessory has a small area when viewed from (in) the axial direction).

In addition or in the alternative to the preceding embodiments, the portable power tool may include a housing that houses at least the electric motor, the output shaft, the first bearing and the second bearing. The housing may be shaped and sized not to protrude outward beyond the tool accessory in a direction from the output shaft toward the motor shaft. According to this embodiment, the above-described problem does not also occur.

In addition or in the alternative to the preceding embodiments, each of the first and second bearings may be a ball bearing. According to this embodiment, the first and second bearings are capable of bearing (supporting) a large load.

A detailed non-limiting embodiment of the present teachings will now be described in further detail with reference to the drawings. In this embodiment, an orbital sander (hereinafter simply referred to as a sander) 10 is described as a representative example of the portable power tool according to the present disclosure. The sander 10 exemplified in this embodiment is a small sander having a relatively small sanding surface area and thus may also be referred to as a mini-sander.

Figure 4:
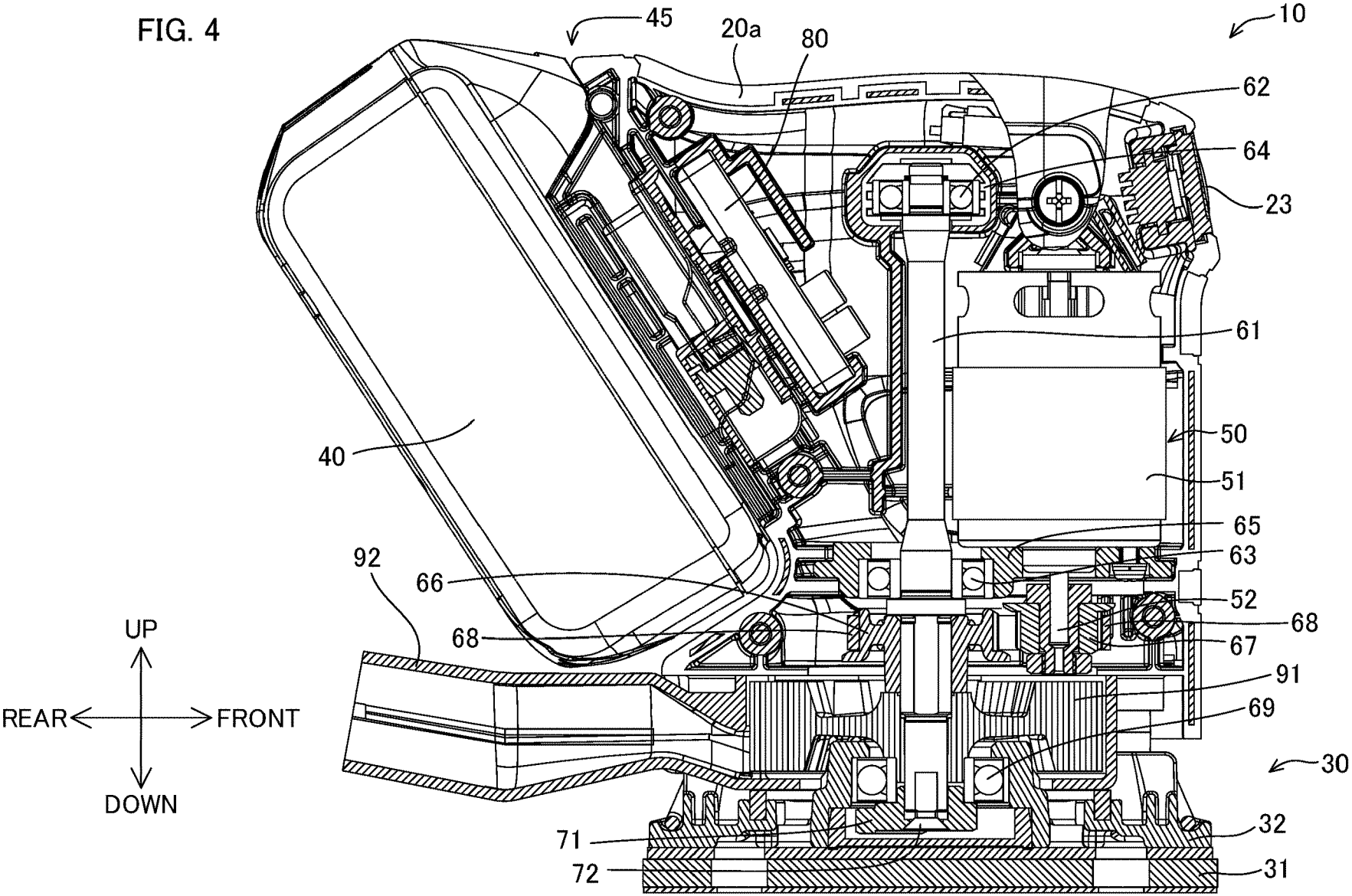
FIG. 4 is a partially sectional view of the sander.
Figure 5:
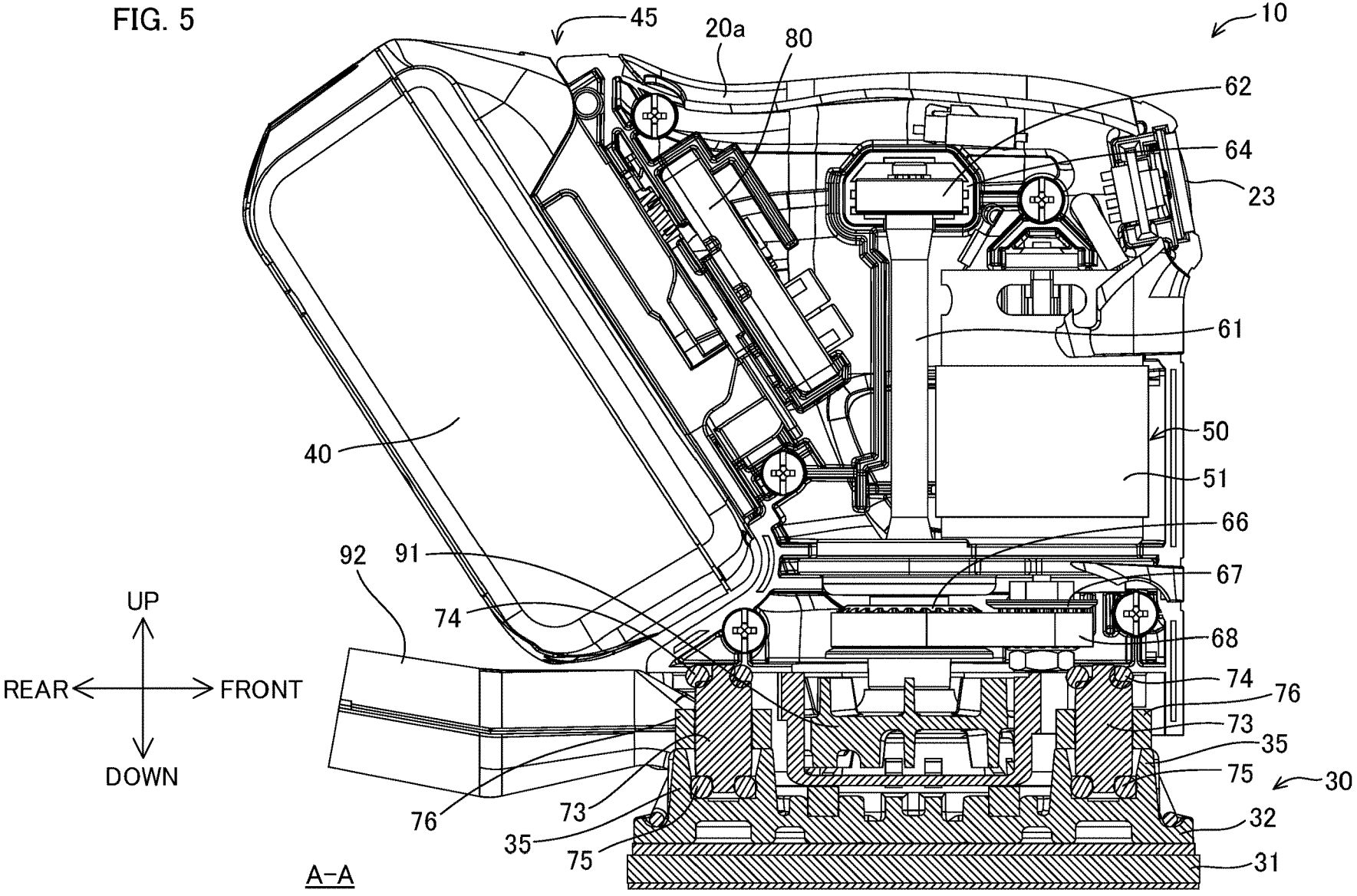
FIG. 5 is a partially sectional view of the sander, taken along line A-A in FIG. 3.

As shown in FIGS. 4 and 5, the sander 10 includes a tool accessory (sanding/polishing part) 30, an electric motor 50 and an output shaft (spindle) 61. A motor shaft 52 of the electric motor 50 and the output shaft 61 are arranged in parallel to each other and each extends in an up-down direction of the sander 10. The motor shaft 52 and the output shaft 61 spaced apart in a front-rear direction of the sander 10, which is a shaft arrangement direction in the present embodiment. Thus, the motor shaft 52 and output shaft 61 lie in a plane defined by the up-down and front-rear directions of the sander 10. One end of the output shaft 61 is operably (e.g., fixedly) connected to the tool accessory 30. The sander 10 is configured such that the rotational driving force (energy) of the electric motor 50 is transmitted to the output shaft 61 and consequently, the tool accessory 30 undergoes an orbital motion when the output shaft rotates 61, which will be described in detail below.

In other words, in the following description, a direction in which the motor shaft 52 and the output shaft 61 are arranged in parallel is defined as the front-rear direction of the sander 10. In the front-rear direction, a first lateral side on which the motor shaft 52 is located is defined as a front side, and a second, opposite lateral side on which the output shaft 61 is located is defined as a rear side. The direction in which the longitudinal (rotational) axes of the motor shaft 52 and the output shaft 61 extend is defined as the up-down direction of the sander 10. In the up-down direction, a first side on which the tool accessory 30 is located is defined as a lower side, and the second, opposite side is defined as an upper side. Further, a direction orthogonal to the front-rear direction and the up-down direction is defined as a left-right direction of the sander 10. In the left-right direction, the right side as viewed from the rear is defined as the right side of the sander 10, and the opposite side is defined as the left side of the sander 10.

Figure 2:
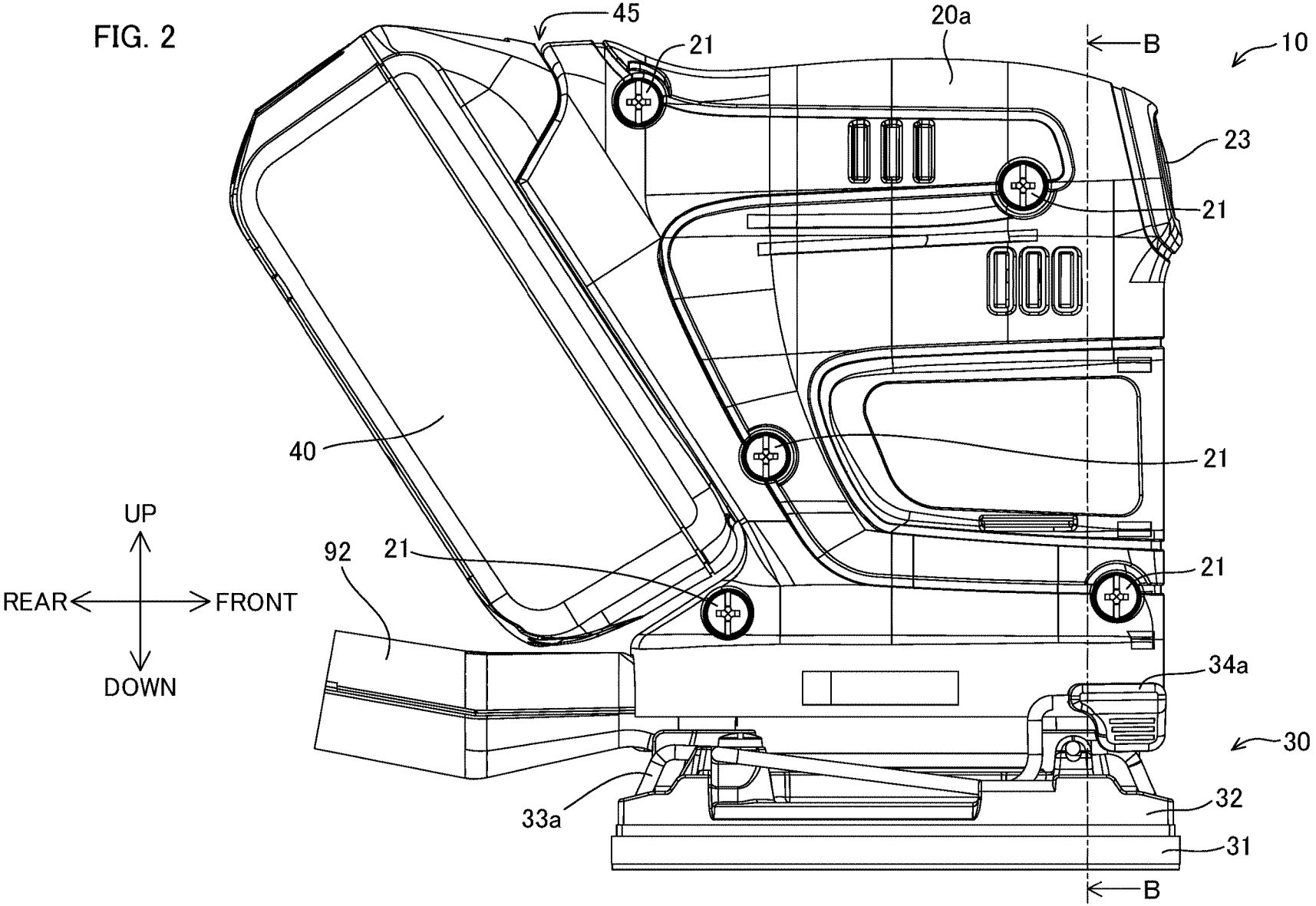
FIG. 2 is a right side view of the sander.
Figure 3:
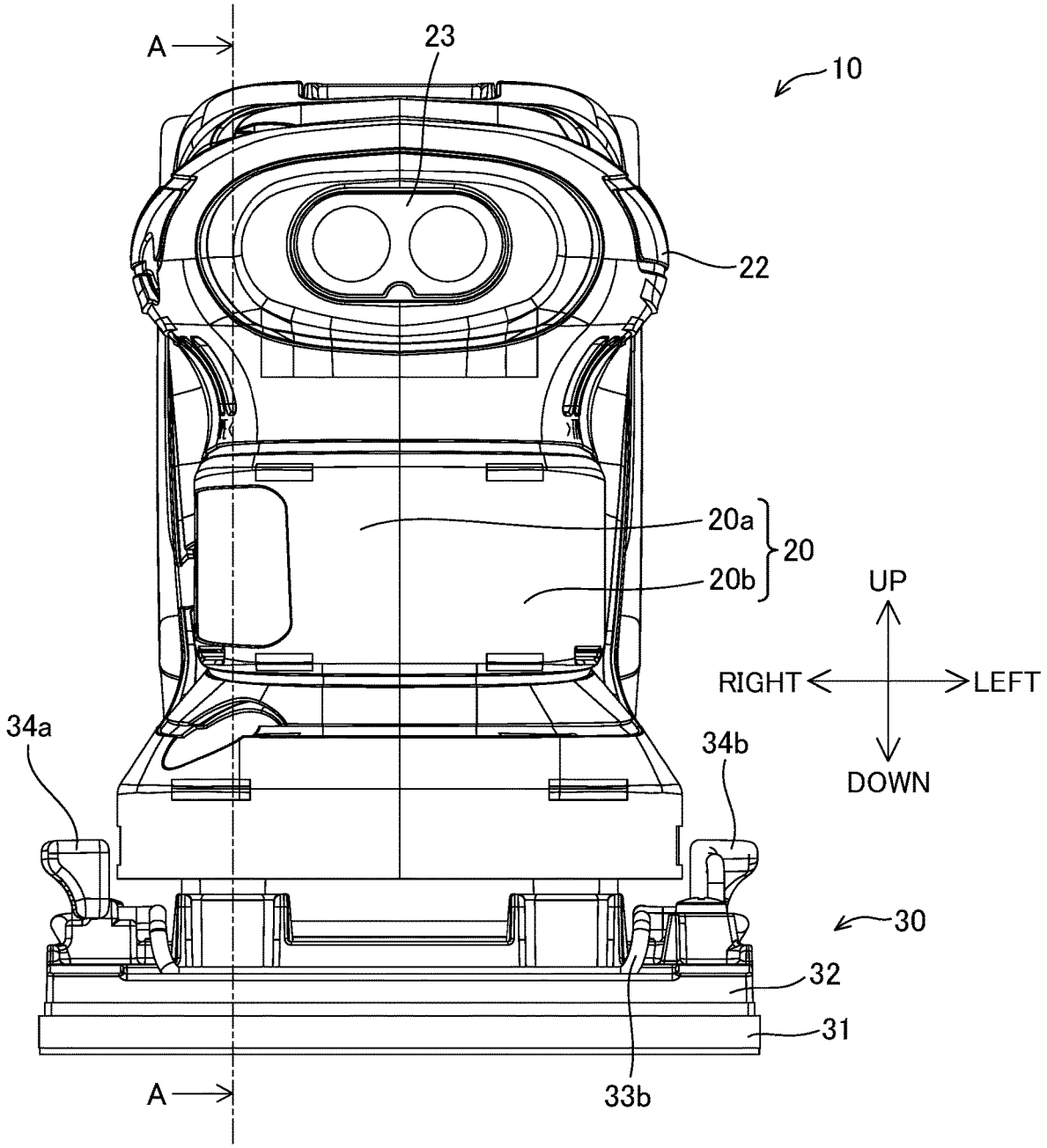
FIG. 3 is a front view of the sander.

As shown in FIGS. 1 to 3, the sander 10 includes a housing 20. The housing 20 has a bottomed cylindrical shape having a closed top. The sander 10 is a so-called palm type sander, and an upper part 22 of the housing 20 is shaped and sized to be held by a user. Specifically, the upper part 22 also functions as a handle to be held by the user in one hand when the sander 10 is used. As shown in FIG. 3, the upper part 22 is formed to have a width that gradually decreases downward in the left-right direction so as to be easy for the user to hold. The housing 20 includes two halves, i.e. a right housing half 20*a* and a left housing half 20*b* (see FIG. 3), which are connected together by a plurality of bolts 21 (see FIG. 2).

As shown in FIG. 4, the electric motor 50 is housed in the housing 20. The electric motor 50 is arranged generally in the center of the housing 20 in the up-down direction, near a front end of the housing 20 in the front-rear direction (see FIG. 4), and generally in the center of the housing 20 in the left-right direction (see FIG. 6). The electric motor 50 is also referred to as "canned motor" and includes a motor case 51 formed of a thin metal plate. The motor case 51 houses a rotor and a stator (not shown) which are components of the electric motor 50. In this embodiment, the electric motor 50 is a brushed (commutated) motor. Use of a canned motor as the electric motor 50 eliminates the need for assembling related parts to or in the housing one by one, thus improving ease of assembly. The electric motor 50 may however be a brushless motor. The motor shaft 52 extends out of a lower end of the motor case 51. A pulley 67 is fixed around a portion of motor shaft 52 that extends out of the motor case 51.

As shown in FIG. 4, the output shaft 61 is rotatably supported by a first bearing 62 and a second bearing 63 within the housing 20. In this embodiment, each of the first and second bearings 62, 63 is a ball bearing. The output shaft 61 extends in parallel to the motor shaft 52 in the up-down direction as described above. The output shaft 61 is arranged to be located at the center of the tool accessory 30 (described below) when viewed from (in) the up-down direction. The first bearing 62 supports an upper end portion of the output shaft 61 and is fixed to the housing 20 via a first bearing retainer 64. The second bearing 63 is located below the first bearing 62 in the up-down direction (or closer to the tool accessory 30 than the first bearing 62) and supports an intermediate portion of the output shaft 61. The second bearing 63 is fixed to the housing 20 via a second bearing retainer 65. The second bearing retainer 65 also supports the motor case 51.

As shown in FIG. 4, the first and second bearings 62, 63 are arranged at positions that do not overlap with a component (also referred to as an outermost component) located on the radially outermost side among components of the electric motor 50 when viewed from (in) the front-rear direction (i.e. in the direction in which the motor shaft 52 and the output shaft 61 are arranged in parallel). In other words, the first bearing 62 is located above an upper end of the outermost component of the electric motor 50 in the up-down direction, and the second bearing 63 is located below a lower end of the outermost component of the electric motor 50 in the up-down direction. The term "radially" used herein refers to a direction orthogonal to an axial direction in which the motor shaft 52 extends. In this embodiment, as clearly seen from FIG. 4, the radially outermost component of the electric motor 50 is the motor case 51. In an embodiment in which the electric motor 50 does not include the motor case 51, generally, the radially outermost component of the electric motor 50 is a stator, in particular in embodiments in which the electric motor 50 is an inner rotor type motor. On the other hand, the radially outermost component of the electric motor 50 is a rotor in embodiments in which the electric motor 50 is an outer rotor type motor.

Further, as shown in FIG. 4, the first and second bearings 62, 63 of this embodiment are arranged to partially overlap with the electric motor 50, when viewed from (in) the up-down direction. In FIG. 4, the motor case 51 (i.e. the radially outermost component of the electric motor 50) overlaps with the outer rings and bearing balls of the first and second bearings 62, 63, but in other embodiments the motor case 51 may overlap only with the outer rings. In an embodiment in which the electric motor 50 does not include the motor case 51, the first and second bearings 62, 63 may partially overlap with an outermost component that is specified depending on the structure of the electric motor 50.

Figure 7:
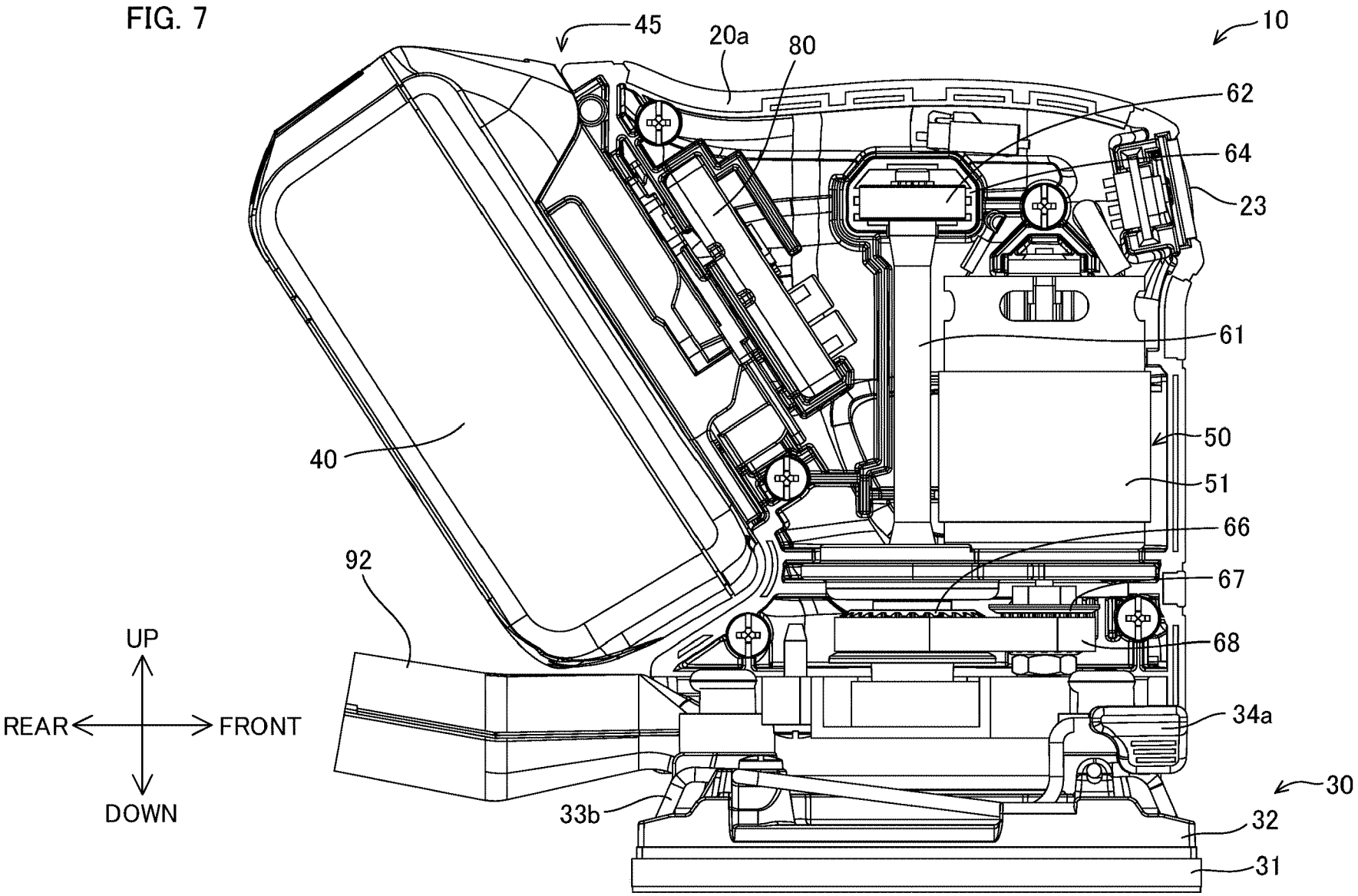
FIG. 7 is a right side view that shows the interior of the sander, with a right housing half removed therefrom.

As shown in FIG. 4, a pulley 66 is fixed around the output shaft 61. The pulley 66 is arranged adjacent to a lower side of the second bearing 63. The pulley 66 is arranged at a position to overlap with the pulley 67 when viewed from (in) the front-rear direction. An endless belt 68 is looped over (around) the pulleys 66, 67 (see FIGS. 4, 5 and 7). In this embodiment, the pulley 66 has a larger diameter than the pulley 67, so that rotation of the motor shaft 52 is decelerated and transmitted to the output shaft 61. Rotation of the motor shaft 52 may however be transmitted to the output shaft 61 without being decelerated, i.e. the pulleys 66, 67 may have the same diameter.

As shown in FIG. 4, a fan 91 is also mounted around the output shaft 61 and underneath the pulley 66. A housing space for the fan 91 is in fluid communication with a dust collecting (extraction) nozzle 92. The dust collecting nozzle 92 extends rearward from a lower rear end part of the housing 20. A fabric or synthetic polymer dust box (not shown), or a hose (not shown) for connection with a dust collecting machine or dust extractor/vacuum can be attached to the dust collecting nozzle 92.

The tool accessory 30 is arranged at the lowermost part of the sander 10, and may include, e.g., a pad 31, a base (platen) 32 and first and second dampers (clamps) 33*a*, 33*b*. The pad 31 and the base 32 have a generally rectangular shape when viewed from (in) the up-down direction. The base 32 is arranged on top of the pad 31 and they are connected together by a bolt (not shown) extending in the up-down direction.

Sandpaper (abrasive paper) (not shown) is mounted on the pad 31 by utilizing the dampers 33*a*, 33*b*. Specifically, the first damper 33*a* extends along a right edge and a rear edge of the base 32 above the base 32, and a first lever 34*a* is mounted on a front end part of the first damper 33*a*. The second damper 33*b* extends along a left edge and a front edge of the base 32 above the base 32, and a second lever 34*b* is mounted on a rear end part of the second damper 33*b*. In order to fix the sandpaper to the pad 31, the sandpaper is placed on a bottom surface of the pad 31, and a rear end of the sandpaper is clamped between the base 32 and a part of the first damper 33*a* extending along the rear edge of the base 32 by manually operating the first lever 34*a*, and further a front end of the sandpaper is clamped between the base 32 and a part of the second damper 33*b* extending along the front edge of the base 32 by manually operating the second lever 34*b*. The bottom surface of the pad 31 supports the sandpaper during use of the sander 10. In a modified embodiment, the bottom (lower) surface of the pad 31 optionally may have hook-and-loop type fasteners, and the sandpaper may have corresponding hook-and-loop type fasteners for detachably attaching to the hook-and-loop type fasteners of the pad 31. In such a modified embodiment, the dampers 33*a*, 33*b* and levers 34*a*, 34*b* may be omitted.

As shown in FIGS. 1 and 2, the tool accessory 30 (in particular, the pad 31) protrudes forward of the housing 20 in the front-rear direction. In other words, the housing 20 is sized and shaped not to protrude forward beyond the tool accessory 30. This design eliminates the following problem. That is, during a sanding operation performed by a sander having a housing that protrudes beyond the tool accessory in the forward direction, the housing may come into contact with a protruding part of a workpiece or surrounding objects. In this case, the tool accessory cannot reach every corner of an area to be sanded. On the other hand, because the pad 31 and thus the sandpaper is larger than the housing 20 in plan view, the housing 20 does not obstruct sanding operations.

As shown in FIG. 4, the tool accessory 30 is connected to the output shaft 61 via an eccentric bearing 69. Specifically, the eccentric bearing 69 is supported between the fan 91 and the base 32 in such a manner as to surround a lower end portion of the output shaft 61. The eccentric bearing 69 is arranged eccentrically to the output shaft 61. An inner ring of the eccentric bearing 69 is supported by a balancer (counterweight) 71 that is arranged (disposed) underneath the eccentric bearing 69. The balancer 71 is fixed to the output shaft 61 by a bolt 72 being threadedly engaged with a threaded hole formed in the lower end of the output shaft 61. The balancer 71 is shaped such that its center of gravity is eccentric in a direction opposite to the eccentric direction of the eccentric bearing 69 with respect to the motor shaft 61. This arrangement reduces the amount of vibration caused by the structure, even though the eccentric bearing 69 is eccentric to the output shaft 61.

Figure 6:
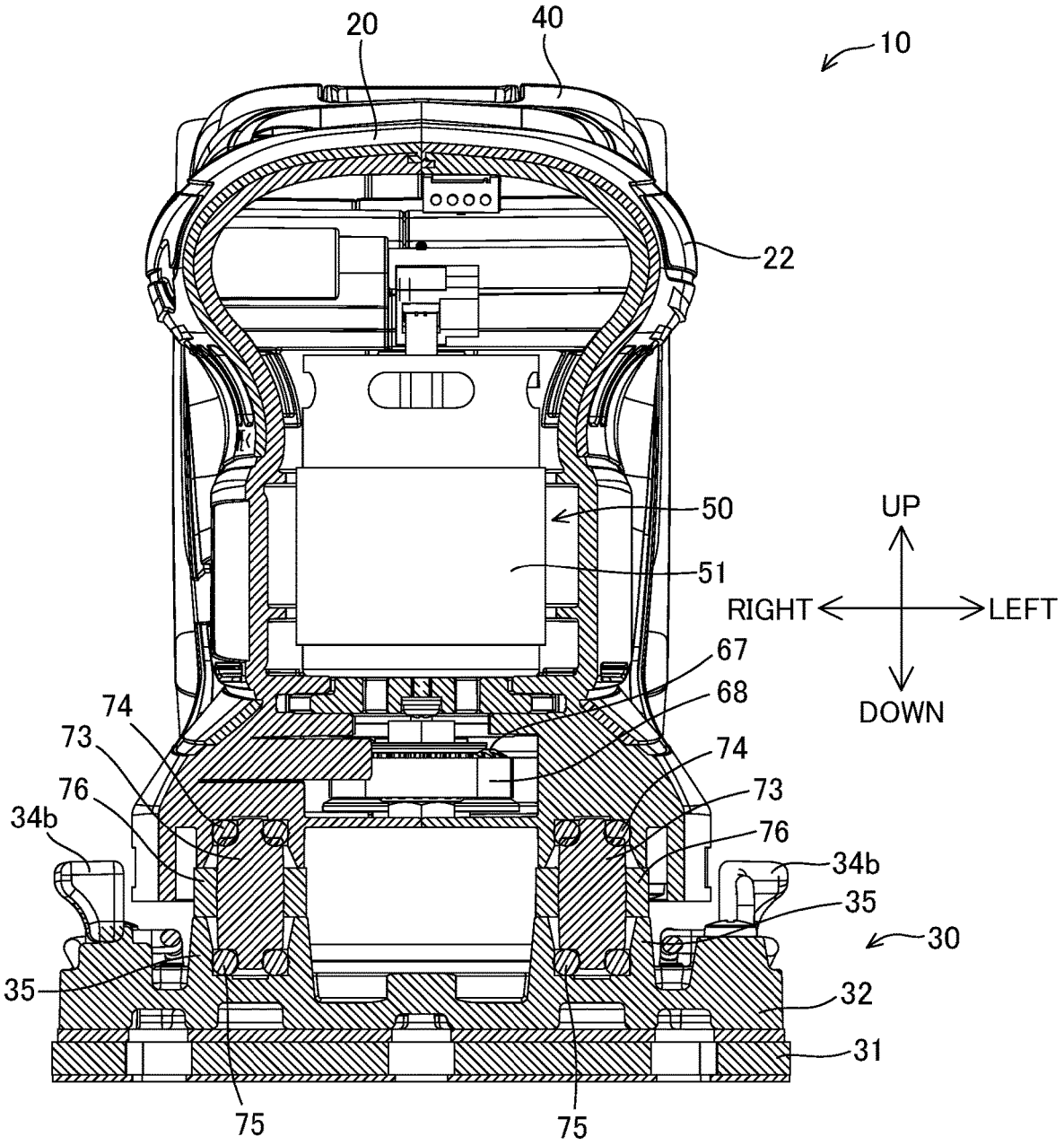
FIG. 6 is a sectional view of the sander, taken along line B-B in FIG. 2.

As shown in FIGS. 5 and 6, the tool accessory 30 is further connected to the housing 20 via four feet 73. The feet 73 are respectively arranged near the four corners of the base 32, which is rectangular shaped. Each of the feet 73 has a generally cylindrical shape extending in the up-down direction. Each of the feet 73 includes small-diameter parts, each having a relatively small diameter, on both its upper and lower ends. An O-ring 74 is arranged around the upper small-diameter part of each of the feet 73 such that the four upper small-diameter parts are respectively engaged with the housing 20 via four of the O-rings 74. An O-ring 75 is arranged around the lower small-diameter part of each of the feet 73 such that the four lower small-diameter parts are respectively engaged with inner surfaces of four bosses 35 of the base 32 via four of the O-rings 75. Each of the feet 73 can be tilted relative to the up-down direction by compressing the respective O-rings 74, 75. A sleeve 76 is provided around each of the feet 73 so as to block or impede the ingress of dust. Each of the four sleeves 76 is formed of an elastic sponge material and is mounted in a slightly compressed state in the up-down direction, to provide an effective dust-proofing (dust-blocking or dust-impeding) measure for each of the feet 73.

As shown in FIGS. 1, 2 and 4, a battery mounting part (battery mount) 45 is arranged behind the output shaft 61 (or on the side opposite to the motor shaft 52 relative to the output shaft 61) in the front-rear direction. More specifically, the battery mounting part 45 is arranged on a rear end part of the housing 20. The battery mounting part 45 is configured such that the battery 40, which serves as a power source for the electric motor 50, is mounted thereon by sliding generally downward from above. In this embodiment, the battery 40 has a nominal rated voltage of 18 V, but it may have a larger or smaller rated voltage. The nominal rated voltage of the battery 50 may be, e.g., 14V-70V, e.g., 18V-40V.

The battery mounting part 45 is arranged to be inclined so as extend away from the output shaft 61 in the direction toward the upper side (i.e. toward the upper side on which the first bearing 62 is located and away from a lower side on which the second bearing 63 is located) in a direction extending away from the output shaft 61. Specifically, the battery mounting part 45 includes guide rails that are inserted into guide grooves formed on the battery 40 and a terminal base (terminal block) that holds one or more terminals 43 for electrical connection with the battery 40. The guide rails and the terminal base are arranged to be inclined so as to extend away from the output shaft 61 in the direction toward the upper side. Thus, when mounted to the battery mounting part 45, the battery 40 is held in an inclined manner such that the battery 40 extends at an angle extending away from the output shaft 61 in the direction toward the upper side. In other words, the guide rails of the battery mounting part 45 are inclined with respect to the axial direction of the output shaft 61, e.g., such that the guide rails and the output shaft 61 form an angle in the range of 20-40°, e.g., 25-35°.

When the battery 40 is mounted on the battery mounting part 45, the battery 40 is held at a lowest position within a range that does not interfere with the dust collecting nozzle 92. At this time, an upper end of the battery 40 is located generally at the same position as the upper end (edge or side) of the housing 20 in the up-down direction. Thus, by arranging the battery 40 such that it is held in an inclined manner as described above, the upper end of the battery 40 does not excessively protrude upward beyond the upper side of the housing 20. Therefore, when the user holds the housing 20 from the rear, the battery 40 does not interfere with an arm of the user. Moreover, by arranging the battery 40 to be held in an inclined manner as described above, it is possible to make the upper part 22 of the housing 20, which is configured to be held (gripped) by the user, larger toward the rear. Therefore, the housing 20 is easy for the user to hold. Furthermore, owing to the inclined arrangement of the battery 40 as described above, although the center of gravity of the sander 10 tends to deviate or be offset toward the side on which the battery 40 is located relative to the output shaft 61 positioned at the center of the tool accessory 30, the user can hold an area closer to the center of gravity since the upper part 22 is extended toward the rear. Therefore, the user can stably hold the sander 10 with a smaller gripping force.

As shown in FIGS. 4 and 5, a controller 80 is housed within the housing 20. The controller 80 is electrically connected to the terminals of the battery mounting part 45 and the electric motor 50 and controls operation (energization) of the electric motor 50 by controlling the amount of electric power (current) that is supplied from the battery 40 to the electric motor 50. In this embodiment, the controller 80 includes a high temperature protection circuit, an overcurrent protection circuit and an overdischarge protection circuit, but one or two of these protection circuits may be omitted.

As shown in FIGS. 4 and 5, the controller 80 is arranged on the side opposite to the electric motor 50 relative to the output shaft 61 in the front-rear direction. In other words, the controller 80 is arranged between the output shaft 61 and the battery mounting part 45 in the front-rear direction. With such arrangement, the controller 80 is arranged relatively far apart from the electric motor 50, so that the controller 80 is less affected by heat generation of the electric motor 50.

Further, as shown in FIGS. 4 and 5, the controller 80 is arranged in (at) a position to partially overlap with the output shaft 61 in the up-down direction. Specifically, the position of the controller 80 in the up-down direction is a position where the controller 80 and the output shaft 61 partially overlap with each other when viewed from (in) a direction orthogonal to the up-down direction. In this embodiment, the controller 80 is arranged to partially overlap with the output shaft 61 when viewed from the front-rear direction. The controller 80 may however be arranged to partially overlap with the output shaft 61 when viewed from any other direction (other than the front-rear direction) orthogonal to the up-down direction. The controller 80 may be arranged to entirely overlap with the output shaft 61. With such arrangement, the size of sander 10 can be reduced in the up-down direction compared with a structure that has the controller 80 arranged above the output shaft 61.

Further, as shown in FIGS. 4 and 5, the controller 80 is arranged to be inclined so as to extend away from the output shaft 61 in the direction toward the upper side (i.e. in the direction toward the upper side on which the first bearing 62 is located and away from the lower side on which the second bearing 63 is located). By arranging the controller 80 such that it is inclined in the same direction as the battery 40 (i.e. such that a plane of the largest surface of the controller 80 is parallel to the extension direction of the guide rails of the battery mounting part 45), the size of the sander 10 can be reduced in the up-down direction. In this embodiment, the inclination angle of the controller 80 is equal to the inclination angle of the battery mounting part 45 relative to the up-down direction or to the axial direction of the output shaft 61. Further, the two largest surfaces of the controller 80 respectively face upward and forward, and downward and rearward. Owing to such an arrangement, the size of the sander 10 can be further reduced in the up-down direction.

As shown in FIG. 3, a switch (i.e. a motor control switch) 23 is provided on an upper part of a front surface of the housing 20. The switch 23 is electrically connected to the controller 80. The switch 23 is configured such that manual operation of the switch 23 causes the electric motor 50 to start and stop. The switch 23 includes a first button for stopping energization (driving) of the motor 60 and a second button for starting and setting the energization (driving) of the motor 60. More specifically, the rotational speed of the motor 60 is successively (sequentially) switched in a predetermined number of steps in a cycle every time the second button is pressed.

The above-described sander 10 operates as follows. First, when the user manually operates (e.g., presses) the switch 23 to drive (start energization of) the electric motor 50, the motor shaft 52 starts rotating. Rotation of the motor shaft 52 is transmitted to the output shaft 61 via the pulleys 66, 67 and the belt 68. Because the eccentric bearing 69 connects the output shaft 61 to the tool accessory 30, when the output shaft 61 rotates, the tool accessory 30 undergoes orbital motion (eccentric circular motion) around the output shaft 61 while compressing the O-rings 74, 75 respectively arranged around the feet 73 and tilting the feet 73. Specifically, the tool accessory 30 moves in such a manner as to draw a circle along a horizontal plane while maintaining its attitude without rotating about the axial direction (rotational axis) of the output shaft 61. In this state, when the bottom surface of the tool accessory 30 is pressed towards the workpiece, the eccentric circular (orbiting) motion of the sandpaper of the tool accessory 30 acts as an abrading motion, and the workpiece is sanded/abraded by the sandpaper attached to the bottom surface of the tool accessory 30.

In the sander 10, the first and second bearings 62, 63 are arranged at positions that do not overlap with an outermost one (a component located on the radially outermost side) of components of the electric motor 50 when viewed from (in) the front-rear direction. Therefore, the first and second bearings 62, 63 for supporting the output shaft 61 do not interfere with the components of the electric motor 50. Therefore, compared with a conventional sander, the motor shaft 52 and the output shaft 61 can be arranged closer to each other in the front-rear direction. Thus, the size of the sander 10 can be reduced in the front-rear direction. Particularly, in the above-described embodiment, the first and second bearings 62, 63 are arranged to partially overlap with the electric motor 50 when viewed from (in) the up-down direction. Therefore, the size of the sander 10 can be further reduced in the front-rear direction. Owing to the arrangement of the above-described embodiment in which the electric motor 50 is arranged to overlap with the outer rings and the bearing balls of the first and second bearings 62, 63, the distance between the motor shaft 52 and the output shaft 61 can be minimized.

By thus reducing the distance between the motor shaft 52 and the output shaft 61, even a small-sized sander 10 can be easily provided with the above-described structure that the housing 20 is sized and shaped not to protrude forward beyond the tool accessory 30.

Although a particular embodiment of the present disclosure is described above in detail for explanation and illustrative purposes, this embodiment is merely intended to facilitate a good understanding of the present teachings and should not be interpreted as restricting the scope of the invention. The present invention may be changed or modified without departing from its spirit and includes its equivalents. Further, any combination or omission of elements described in the claims and the specification may be made within a range in which, e.g., at least part of the above-described problem(s) can be solved or within a range in which, e.g., at least part of the above-described effect(s) can be obtained.

For example, if the first bearing 62 has a larger diameter than the second bearing 63, not both of the first and second bearings 62, 63 but only the first bearing 62 may be arranged to partially overlap with an outermost component when viewed from (in) the up-down direction. In some such embodiments, the distance between the motor shaft 52 and the output shaft 61 can also be minimized. Further, the first and second bearings 62, 63 may be arranged at any positions where they do not overlap with the outermost component of the electric motor 50 when viewed from (in) the front-rear direction. In such an embodiment, compared with a conventional sander, the size of the sander 10 can also be reduced in the front-rear direction.

Further, the sander 10 may include a power cord for connection with an AC power source, in place of the battery 40 and the battery mounting part 45.

Further, one or more additional shafts may be provided between the motor shaft 52 and the output shaft 61. In such a modified embodiment, rotation of the motor shaft 52 may be transmitted to the output shaft 61 via the one or more additional shafts.

Moreover, the present teachings, as applied above to the above-described embodiment, are not limited to small orbital sanders, but also may be advantageously applied to any type of portable or hand-held power tool in which a motor shaft and an output shaft are arranged in parallel. For example, the present teachings may also be applied to a large orbital sander (also referred to as a finishing sander), a random orbital sander or a polisher.

As used herein, the term "tool accessory" is intended to encompass or be, without limitation, a pad or plate designed to detachably hold sandpaper (e.g., abrasive disks or rectangular abrasive papers), a polishing material such as a sponge pad, a felt pad, a wool pad, a bonnet, etc., by using, e.g., clamps, clips, hook-and-loop type fasteners, etc., as well as other types of accessories or attachments that may be integrally attached to a device (e.g., a splined collar, a lock nut, etc.) designed to detachably attach the accessory or attachment to the output shaft (spindle), such as a disk (e.g., a grinding disk), an integrated polishing pad or abrasive pad, a wire wheel, a wire brush, a nylon wheel, a nylon brush, etc.

Although some aspects of the present disclosure have been described in the context of a device, it is to be understood that these aspects also represent a description of a corresponding method, so that each block, part or component of a device, such as the controller 80, is also understood as a corresponding method step or as a feature of a method step. In an analogous manner, aspects which have been described in the context of or as a method step also represent a description of a corresponding block, part, detail, algorithm or feature of a corresponding device, such as the controller 80.

Depending on certain implementation requirements, exemplary embodiments of the controller 80 of the present disclosure may be implemented in hardware and/or in software. The implementation can be configured using a digital storage medium (non-transitory computer-readable medium), for example one or more of a ROM, a PROM, an EPROM, an EEPROM or a flash memory, on which electronically readable control signals (program code—computer-readable instructions) are stored, which interact or can interact with a programmable hardware component such that the respective method is performed.

A programmable hardware component can be formed by a processor, a computer processor (CPU=central processing unit), an application-specific integrated circuit (ASIC), an integrated circuit (IC), a computer, a system-on-a-chip (SOC), a programmable logic element, or a field programmable gate array (FGPA), as well as a microprocessor.

The digital storage medium can therefore be machine- or computer readable. Some exemplary embodiments thus comprise a data carrier or non-transient computer readable medium which includes electronically readable control signals which are capable of interacting with a programmable computer system or a programmable hardware component such that one of the methods described herein is performed. An exemplary embodiment is thus a data carrier (or a digital storage medium or a non-transient computer-readable medium) on which the program for performing one of the methods described herein is recorded.

In general, exemplary embodiments of the present disclosure, in particular the controller 80, are implemented as a program, firmware, computer program, or computer program product including a program, or as data, wherein the program code or the data is operative to perform one of the methods if the program runs on a processor or a programmable hardware component. The program code or the data can for example also be stored on a machine-readable carrier or data carrier. The program code or the data can be, among other things, source code, machine code, bytecode or another intermediate code.

A program according to an exemplary embodiment can implement one of the methods during its performing, for example, such that the program reads storage locations or writes one or more data elements into these storage locations, wherein switching operations or other operations are induced in transistor structures, in amplifier structures, or in other electrical, optical, magnetic components, or components based on another functional principle. Correspondingly, data, values, sensor values, or other program information can be captured, determined, or measured by reading a storage location. By reading one or more storage locations, a program can therefore capture, determine or measure sizes, values, variable, and other information, as well as cause, induce, or perform an action by writing in one or more storage locations, as well as control other apparatuses, machines, and components, and thus for example also perform complex processes in the controller 80.

Therefore, although some aspects of the controller 80 may have been identified as "parts" or "steps", it is understood that such parts or steps need not be physically separate or distinct electrical components, but rather may be different blocks of program code that are executed by the same hardware component, e.g., one or more microprocessors.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved power tools.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

DESCRIPTION OF THE REFERENCE NUMERALS

10: sander, 20: housing, 20*a*: right housing, 20*b*: left housing, 21: bolt, 22: upper part, 23: switch, 30: tool accessory, 31: pad, 32: base, 33*a*, 33*b*: damper, 34*a*, 34*b*: lever, 35: boss, 40: battery, 45: battery mounting part, 50: electric motor, 51: motor case, 52: motor shaft, 61: output shaft, 62: first bearing, 63: second bearing, 64, 65: bearing retainer, 66, 67: pulley, 68: belt, 69: bearing, 71: balancer, 72: bolt, 73: foot, 74, 75: O-ring, 76: sleeve, 80: controller, 91: fan, 92: dust collecting nozzle

The invention claimed is:

1. A portable power tool, comprising:

an electric motor including a motor shaft;

an output shaft arranged non-coaxially with and in parallel to the motor shaft and configured to be driven by rotation of the motor shaft;

a tool accessory operably connected to the output shaft and configured undergo an orbital and/or rotational motion in response to rotation of the output shaft;

a first bearing that rotatably supports the output shaft;

a second bearing that rotatably supports the output shaft and is arranged closer to the tool accessory than the first bearing in an axial direction in which the output shaft extends, and a third bearing that connects the output shaft and the tool accessory and is arranged closer to the tool accessory than the second bearing in the axial direction and eccentrically to the output shaft, wherein the first and second bearings are arranged at positions such that a radially outermost component of the electric motor is interposed between at least outer rings of the first and second bearings in a direction parallel to the axial direction of the output shaft.

2. The portable power tool according to claim 1, wherein the first bearing is arranged to partially overlap with the electric motor when viewed in the axial direction of the output shaft.

3. The portable power tool according to claim 1, further comprising a controller configured to control operation of the electric motor.

4. The portable power tool according to claim 3, wherein the controller is arranged on a first lateral side that is opposite of the motor shaft with respect to the output shaft in the shaft arrangement direction.

5. The portable power tool according to claim 3, wherein the controller is arranged at a position that at least partially overlaps with the output shaft in the axial direction of the output shaft.

6. The portable power tool according to claim 4, further comprising:

a battery mounting part arranged on the first lateral side that is opposite to the motor shaft with respect to the output shaft in the shaft arrangement direction, wherein:

the battery mounting part is configured to detachably attach a battery serving as a power source for the electric motor and to hold the battery inclined to extend away from the output shaft in a direction toward a first side on which the first bearing is located and away from a second side on which the second bearing is located, and the controller is arranged between the output shaft and the battery mounting part in the shaft arrangement direction and is inclined to extend away from the output shaft in the direction toward the first side on which the first bearing is located and away from the second side on which the second bearing is located.

7. The portable power tool according to claim 6, further comprising the battery.

8. The portable power tool according to claim 6, further comprising:

a housing that houses the electric motor, the output shaft, the first bearing, the second bearing and the controller, wherein:

the housing is shaped and sized such that a user can hold a part of the housing on a side opposite to the second bearing relative to the first bearing in the axial direction, and the battery mounting part is arranged on an end part of the housing on a side opposite to the motor shaft with respect to the output shaft in the shaft arrangement direction.

9. The portable power tool according to claim 8, wherein the housing is shaped and sized not to protrude outward beyond the tool accessory in a direction from the output shaft toward the motor shaft.

10. The portable power tool according to claim 1, further comprising:

a housing that houses at least the electric motor, the output shaft, the first bearing and the second bearing, wherein the housing is shaped and sized not to protrude outward beyond the tool accessory in a direction from the output shaft toward the motor shaft.

11. The portable power tool according to claim 1, wherein each of the first and second bearings is a ball bearing.

12. The portable power tool according to claim 9, wherein the first bearing is arranged to partially overlap with the electric motor when viewed in the axial direction of the output shaft.

13. The portable power tool according to claim 12, wherein the controller is arranged at a position that at least partially overlaps with the output shaft in the axial direction of the output shaft.

14. The portable power tool according to claim 13, further comprising the battery.

15. The portable power tool according to claim 14, wherein each of the first and second bearings is a ball bearing.

16. A hand-held power tool, comprising:

an electric motor having a motor shaft;

an output shaft arranged in parallel to the motor shaft and configured to be driven by rotation of the motor shaft;

a tool accessory operably connected to the output shaft and configured undergo an orbital and/or rotational motion in response to rotation of the output shaft;

a first bearing that rotatably supports the output shaft; and a second bearing that rotatably supports the output shaft and is arranged closer to the tool accessory than the first bearing in an axial direction of the output shaft, wherein:

the first and second bearings are arranged at positions such that a radially outermost component of the electric motor is interposed between at least outer rings of the first and second bearings in a direction parallel to the axial direction of the output shaft, and at least part of the radially outermost component of the electric motor is located at a position closer to the output shaft than radially outer edges of the outer rings of the first and second bearings.

17. The hand-held power tool according to claim 16, wherein the radially outermost component of the electric motor is interposed between at least outer rings and rolling elements of the first and second bearings in the direction parallel to the axial direction of the output shaft.

18. The hand-held power tool according to claim 17, further comprising:

a controller having a planar shape, and a battery having a longest dimension, wherein the planar shape of the controller and the longest dimension of the battery are inclined relative to the axial direction of the output shaft such that portions of the controller and battery that are closest to the second bearing are closer to the output shaft than portions of the controller and the battery that are closest to the first bearing.

19. The hand-held power tool according to claim 18, wherein an uppermost end of the controller in the direction parallel to the axial direction of the output shaft is lower than an uppermost edge of the hand-held power tool in the axial direction of the output shaft.

20. The hand-held power tool according to claim 19, further comprising an eccentric bearing operably coupling the output shaft to the tool accessory.

* * * * *